US008517034B2

(12) United States Patent
De Boni et al.

(10) Patent No.: US 8,517,034 B2
(45) Date of Patent: Aug. 27, 2013

(54) PERMANENT RESHAPING PROCESS USING A HEATING MECHANICAL TENSIONING DEVICE

(75) Inventors: Maxime De Boni, Tokyo (JP); Hiroshi Takahashi, Tokyo (JP)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 12/639,317

(22) Filed: Dec. 16, 2009

(65) Prior Publication Data

US 2010/0307525 A1 Dec. 9, 2010

Related U.S. Application Data

(60) Provisional application No. 61/144,512, filed on Jan. 14, 2009, provisional application No. 61/144,514, filed on Jan. 14, 2009, provisional application No. 61/144,516, filed on Jan. 14, 2009, provisional application No. 61/146,396, filed on Jan. 22, 2009.

(30) Foreign Application Priority Data

| | | |
|---|---|---|
| Dec. 16, 2008 | (FR) | 0858649 |
| Dec. 16, 2008 | (FR) | 0858652 |
| Dec. 16, 2009 | (FR) | 0858653 |
| Dec. 16, 2009 | (FR) | 0858665 |

(51) Int. Cl.

| | |
|---|---|
| ***A45D 7/06*** | (2006.01) |
| ***A45D 7/04*** | (2006.01) |
| ***A45D 7/02*** | (2006.01) |
| ***A45D 2/00*** | (2006.01) |
| ***A45D 37/00*** | (2006.01) |

(52) U.S. Cl.

USPC ..... 132/206; 132/205; 132/207; 132/211; 132/221

(58) Field of Classification Search

USPC ..... 132/206, 200, 202–205, 207–212, 132/163, 220–223, 245, 269, 270, 271, 226–229, 132/236–238, 240, 241, 243, 246, 247, 250, 132/252–256, 261, 272; 219/222, 225, 226; 424/70.1, 70.2

See application file for complete search history.

(56) References Cited

U.S. PATENT DOCUMENTS

| | | | | | |
|---|---|---|---|---|---|
| 1,481,109 | A | * | 1/1924 | Nessler | 132/206 |
| 1,712,489 | A | * | 5/1929 | Brown | 132/206 |
| 1,892,106 | A | * | 12/1932 | Jancke | 132/206 |
| 1,892,389 | A | * | 12/1932 | Evans | 132/206 |
| 1,926,987 | A | * | 9/1933 | Durham et al. | 132/222 |
| 2,173,269 | A | * | 9/1939 | Brown | 132/220 |
| 2,533,958 | A | * | 12/1950 | Root et al. | 132/220 |
| 3,347,248 | A | * | 10/1967 | Weitzner | 132/252 |
| 3,545,457 | A | * | 12/1970 | Schepis | 132/222 |
| 3,863,653 | A | * | 2/1975 | Boudouris et al. | 132/200 |
| 4,061,898 | A | | 12/1977 | Murray et al. | |
| 4,259,566 | A | * | 3/1981 | Kobayashi | 219/222 |
| 4,481,961 | A | * | 11/1984 | Bauer et al. | 132/203 |
| 4,510,952 | A | * | 4/1985 | Gikas | 132/221 |
| 4,526,184 | A | * | 7/1985 | Caruso | 132/221 |
| 4,627,452 | A | * | 12/1986 | Caruso | 132/229 |
| 4,840,791 | A | * | 6/1989 | Mathews et al. | 424/70.5 |
| 4,982,749 | A | * | 1/1991 | Baker et al. | 132/204 |
| 5,299,367 | A | * | 4/1994 | Johnson et al. | 34/95 |
| 5,365,953 | A | | 11/1994 | Feughelman | |
| 5,551,453 | A | * | 9/1996 | Sturla | 132/206 |
| 5,584,308 | A | | 12/1996 | Maekawa | |
| 5,588,449 | A | * | 12/1996 | Falcon | 132/208 |
| 5,749,379 | A | * | 5/1998 | Stillwagon et al. | 132/200 |
| 6,116,250 | A | * | 9/2000 | Buheitel | 132/205 |
| 6,173,717 | B1 | * | 1/2001 | Schonert et al. | 132/202 |
| 7,562,661 | B2 | * | 7/2009 | Ueyama et al. | 132/206 |
| 2008/0011315 | A1 | * | 1/2008 | Schreiber et al. | 132/210 |
| 2008/0185014 | A1 | | 8/2008 | Campain | |
| 2009/0194124 | A1 | * | 8/2009 | Malle et al. | 132/206 |

FOREIGN PATENT DOCUMENTS

| | | |
|---|---|---|
| DE | 199 42 350 A1 | 8/2001 |
| EP | 1 935 275 A1 | 6/2008 |
| GB | 617491 | 2/1949 |

OTHER PUBLICATIONS

English-language abstract for DE 19942350 (A1) from espacenet.
French Search Report for FR 0858649, Jul. 7, 2009, Examiner D. Lang.
French Search Report for FR 0858652, Jul. 7, 2009, Examiner D. Lang.
French Search Report for FR 0858653, Jul. 7, 2009, Examiner D. Lang.
French Search Report for FR 0858665, Jul. 7, 2009, Examiner D. Lang.

* cited by examiner

*Primary Examiner* — Vanitha Elgart
(74) *Attorney, Agent, or Firm* — O'Brien Jones, PLLC

(57) ABSTRACT

Provided is a process for permanently reshaping keratin fibers comprising: a) placing the keratin fibers under mechanical tension by rolling keratin fibers on a tensioning device so as to form curls, b) applying a reducing composition to the keratin fibers, c) individually covering each tensioning device rolled with keratin fibers with a cover comprising at least one heat-insulating material so as to form at least one closed space above the keratin fibers, and e) heating the keratin fibers at a constant temperature ranging from 45 to 250° C., for a period of time ranging from 1 minute to 2 hours, wherein at least one of the tensioning device and the cover comprising at least one heat-insulating material further includes at least one heat source. Also provided is a kit for permanently reshaping keratin fibers.

17 Claims, No Drawings

PERMANENT RESHAPING PROCESS USING A HEATING MECHANICAL TENSIONING DEVICE

The present invention relates to a process for permanently reshaping the hair, comprising, inter alia, a step of heating the hair using a heating mechanical tensioning device. The invention also relates to the heating mechanical tensioning device.

The most common technique for permanently reshaping the hair consists, in a first stage, in opening the —S—S— disulfide bonds of keratin (keratocystine) using a composition containing suitable reducing agent (reduction step) and then, after having rinsed the head of hair thus treated, generally with water, in reforming the said disulfide bonds in a second stage by applying to the hair, which has been placed under tension beforehand, for example with curlers, an oxidizing composition (oxidation step, also known as the fixing step) so as finally to give the hair the desired shape. This technique thus makes it possible to make the hair wavy (permanent-waving process). The new shape imposed on the hair via a chemical treatment as above is eminently long-lasting and especially resistant to the action of washing with water or shampoo, as opposed to simple standard techniques of temporary reshaping, such as hairsetting.

Permanent reshaping processes that are more efficient and less harmful to keratin fibres and that lead to longer-lasting hair reshaping are constantly being sought.

In order to improve the performance qualities of permanent-waving processes, the compositions generally used contain large concentrations of reducing agent(s). With the same aim, a heating process during the reduction step has also been developed, in order to increase the chemical action of the reducing agent(s). These techniques use hot air, hot steam or infrared to heat the hair fixed on a roller or a curler.

It has been observed that these techniques do not lead to a large improvement in terms of longevity of the hair reshaping, for instance curls, when compared with standard permanent-waving techniques without heating. Furthermore, the treated hair shows substantial degradation, which hinders users from performing repeated hair treatments, such as successive permanent waving or a combination of permanent waving and dyeing, for example.

Document EP 1 935 275 describes a process for reshaping the hair using self-reclosable flexible curlers. Example 2 of that document describes a process in which a reducing composition is applied to flexible curlers and a plastic film is wound around the head. Heating under a hood is performed for 15 minutes until the hair is completely dry. An oxidizing composition is then applied. After a standing time of 5 minutes, the curlers are removed. However, this process can be further improved, since the shape and liveliness of the curls are still insufficient.

There is thus a need to find a process for placing the hair under tension, giving curls of improved shape and liveliness.

Thus, the invention relates to a process for permanently reshaping keratin fibres, in particular the hair, comprising:

a) a step of placing the keratin fibres under mechanical tension by rolling them up on mechanical tensioning means so as to form curls, b) a step of applying a reducing composition to the keratin fibres, c) an optional step of rinsing the said fibres, and then d) a step of placing one or more means for covering the said mechanical tensioning means to form one or more closed spaces above the hair, and then e) a step of heating the said fibres at a constant temperature, to within 2° C. or 3° C., of between 45 and 250° C. for a period of between 1 minute and 2 hours, and then f) an optional step of fixing by oxidation after removing the covering means, characterized in that at least one of the said mechanical tensioning means and of the said one or more covering means includes one or more heating means.

When the covering means is placed on the mechanical tensioning means, they together form closed and occlusive structure in particular in which the heat can diffuse. This closed and occlusive structure is termed "closed space".

Advantageously, a covering means is placed over each curler, i.e. a covering means individually cover each of the curlers. This embodiment of the process according to the invention by individual covering, curler by curler, has the advantage of preventing running onto the scalp of the reducing composition applied in step b).

According to another embodiment of the process according to the invention, the covering means covers all the curlers, i.e. it covers the entire head.

According to one variant of the invention, the closed space may comprise open regions, the surface area of which is less than 5%, preferably less than 3% and more particularly less than 0.5% of the total surface area of the covering means. In practice, a person skilled in the art will know how to make these open regions, so as not to disrupt the diffusion of heat in the closed space.

The apertures may be passages, holes or orifices, which may allow an exchange of air between the closed space and the exterior, especially when the condensation inside the closed space is too great.

In the process according to the invention, the temperature is established, adjusted and regulated by means of the heating means and it is measured on the hair with the aid of a thermometric probe, for example the Digital Surface Sensor Module probe, reference MT-144, sold by the company Sakaguchi E. H. VOC CORP. (Japan). This probe is generally placed on a single hair, and more advantageously on a portion of hair that is directly in contact with the closed space, even more advantageously on a portion of hair that is directly in contact with the closed space and which forms the final roll on the curler.

Preferably, the temperature measurement is taken at normal atmospheric pressure equal to 101 325 Pa.

According to the invention, the temperature of the hair is identical, to within 2° C. or 3° C., over the entire head of the person and the probe can be placed anywhere on the hair.

In addition, the hair reshaping process according to the invention leads to the production of the same temperature for all the hair, to within 2° C. or 3° C., and also to maintenance of a constant temperature of the hair, to within 2° C. or 3° C., throughout the heating at a fixed given temperature. In this way, the shaping of the hair is regular and uniform throughout the head of hair and the final hairstyle is more controlled.

Advantageously, the covering means comprises one or more heat-insulating materials, and even more advantageously, the covering means is formed solely by heat-insulating materials.

The term "heat-insulating material" means materials with an electrical conductivity of between 0 and 1 W/m. ° C. (PVC: 0.17 W/m. ° C.).

Preferably, the heating means is adjusted so that the temperature detected on the hair is greater than or equal to 70° C., better still greater than or equal to 75° C. and less than 150° C., and preferably less than 100° C. Preferably, the heating is heating by electrical resistance.

Advantageously, the covering means is impermeable to the composition of step (b).

According to the invention, the closed space forms a condensation cage, in which water or the composition of step (b) evaporates from the hair by heating, is deposited on the walls of the covering means and then falls again onto the hair, this cycle being repeated one or more times throughout the heating. In this way, the hair is permanently humidified during the heating, which prevents it from drying out and degrading.

The production of the closed space is an important characteristic of the process according to the invention, since this space leads to a constant temperature on the hair, which coexists with permanent humidification thereof.

The process according to the invention may advantageously comprise an additional step, consisting in tightening the covering means using an elastic, a stretchable strip or a stretchband on the person's head.

Preferably, in the process according to the invention, the covering means is placed less than 20 mm, preferably less than 10 mm and better still less than 5 mm from the hair forming the final roll of each curler. According to the invention, the term "distance between the hair forming the final roll of each curler" and the covering means the minimum measurable distance between the hair forming the final roll of each curler and the covering.

As a result of the closed space defined according to the invention, which causes successive condensations of the reducing composition on the hair, the process according to the invention has the advantage of using an amount of reducing agents that is generally less than the amount used in most of the processes of the prior art.

Advantageously, the reducing agent(s) represent 0.3% to 3% by weight relative to the total weight of the reducing composition.

The invention also relates to a mechanical tensioning device comprising:

at least one means for placing keratin fibres under mechanical tension, and at least one means for covering the said fibres, characterized in that the said mechanical tensioning means or the said covering means, or both these means, include(s) a heating means and are capable of producing a closed space when they are placed on a person's head.

The invention also relates to the use of this device for permanently reshaping keratin fibres.

Finally, the invention relates to a kit.

Other characteristics, aspects, subjects and advantages of the present invention will emerge even more clearly on reading the description that follows.

The process for permanently reshaping keratin fibres, in particular the hair, comprises a first step (a) of placing the keratin fibres under mechanical tension by rolling them up on mechanical tensioning means so as to form curls.

The rolling-up on the mechanical tensioning devices may be performed on the entire length of the hair or on half the length of long hair. Depending on the desired hairstyle shape and amount of curls, the rolling-up is performed with more or less thick locks.

According to the process of the invention, the mechanical tensioning means may be a curler, a roller or a clip.

A step of applying to the keratin fibres a reducing composition (b) then follows, to reduce the disulfide bonds of keratin, followed by an optional standing time.

According to one variant of the process according to the invention, the step of applying the reducing composition (noted b)) to the keratin fibres may precede the step of placing the keratin fibres under mechanical tension (noted a)), with or without a standing time. In this case, the reduction step is performed in the original shape of the fibres, i.e. on fibres not placed under tension.

According to a first embodiment of the process according to the invention, the reducing composition according to the invention has an alkaline pH, preferably of between 7 and 13, more particularly between 8 and 10 and better still between 8 and 9.5.

According to a second embodiment of the process according to the invention, the reducing composition according to the invention has an acidic pH, i.e. a pH of between 1 and 7, preferably between 3 and 7 and better still between 4 and 6.5.

The reducing composition according to the invention comprises one or more thiol or non-thiol reducing agents.

1. Thiol Reducing Agents

The reducing composition used in the process according to the invention preferentially comprises, in a cosmetically acceptable medium, one or more thiol reducing agents chosen from thioglycolic acid, thiolactic acid, mercaptopropionic acid, monothio-glycerol, cysteamine and cysteine, a derivative thereof, a salt thereof, an ester thereof, a hydrate thereof or an isomer thereof.

The reducing composition used in the process according to the invention more preferentially comprises, in a cosmetically acceptable medium, one or more thiol reducing agents chosen from those listed hereinbelow or a derivative thereof, a salt thereof, an ester thereof, a hydrate thereof or an isomer thereof:

thioglycolic acid of formula (1):

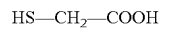

$$HS—CH_2—COOH \quad (1),$$

thiolactic acid of formula (2):

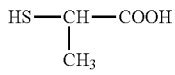

$$HS—\underset{\underset{CH_3}{|}}{CH}—COOH \quad (2)$$

3-mercaptopropionic acid of formula (3):

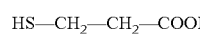

$$HS—CH_2—CH_2—COOH \quad (3),$$

cysteamine of formula (4)

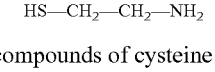

$$HS—CH_2—CH_2—NH_2 \quad (4),$$

compounds of cysteine type of formula (5):

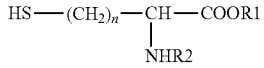

$$HS—(CH_2)_n—\underset{\underset{NHR2}{|}}{CH}—COOR1$$

with R1 denoting H or a linear or branched C1-C10 alkyl radical, or an ion derived from an organic or mineral base, and R2 denoting H or a linear or branched C1-C10 alkyl radical, or an ion derived from an organic or mineral base, or a linear or branched C2-C10 acyl radical, and n denoting 1 or 2.

Among the compounds of formula (5), preferred compounds that may be mentioned include cysteine and its salts, homocysteine and its salts, N-acetylcysteine and methyl cysteinate.

Examples of cysteamine esters are N-substituted cysteine derivatives, for instance N-acetylcysteine, N-alkanoylcysteines, N-aroylcysteines, N-acetylated cysteine amides, alkyl esters of cysteine and/or salts thereof.

DL-Cysteine and N-acetylcysteine are preferred.

Among the cosmetically acceptable salts of products (1) to (4) above, mention may be made more particularly of the ammonium salts, the primary, secondary or tertiary amine salts and the alkaline-earth metal salts. The primary, secondary or tertiary amine salts that may be mentioned, respectively, include monoethanolamine, diisopropanolamine and triethanolamine.

Among the esters of compounds (1) to (4) above, mention may be made of glyceryl monothioglycolate, ethylene glycol monothioglycolate, the azeotropic mixture of 2-hydroxypropyl thioglycolate and of 2-hydroxy-1-methylethyl thioglycolate described in patent application FR-A-2 679 448, glyceryl monothiolactate, ethylene glycol monothiolactate, glyceryl 3-mercaptopropionate and ethylene glycol 3-mercaptopropionate.

Among the cosmetically acceptable salts of the above reducing agents of formula (5), mention may be made more particularly of the hydrochlorides, hydrobromides, citrates, acetates and sulfates.

The reducing agent(s) generally represent(s) from 0.01% to 20%, preferably from 0.1% to 10% and better still from 0.3% to 3% by weight relative to the total weight of the reducing composition.

2. Non-Thiol Reducing Agent

Preferentially, the reducing composition used in the process according to the invention comprises, in a cosmetically acceptable medium, one or more non-thiol reducing agents chosen from non-sulfur or protected-thiol reducing agents, sulfites, bisulfites or sulfinic acid derivatives, a derivative thereof, a salt thereof, an ester thereof, a hydrate thereof or an isomer thereof.

For the purposes of the present invention, the term "protected thiol" means any molecule capable of generating a thiol via a simple chemical or photochemical reaction (for example hydrolysis).

Among the protected thiols that may be used according to the invention, mention may be made of thioesters, thiocarbonates, thiocarbamates and thioethers.

Preferably, the reducing agent(s) is (are) chosen from non-sulfur reducing agents. For the purposes of the present invention, the term "non-sulfur reducing agent" means a reducing agent not comprising any sulfur atoms in its structure.

The non-sulfur reducing agent(s) included in the composition according to the invention is (are) preferably chosen from phosphines, alkali metal or alkaline-earth metal hydrobromides, reducing sugars and reductones.

As phosphines that may be used in the composition according to the invention, mention may be made of monophosphines or diphosphines as described in patent FR 2 870 119.

As borohydrides that may be used in the composition according to the invention, mention may be made of sodium or potassium borohydride.

Reducing sugars that may be mentioned, in a non-limiting manner, include ribose, glucose, maltose, galactose, lactose and xylose.

Among the reductones of the invention, ascorbic acid and erythorbic acid are preferred.

The said reducing agent(s) may also be chosen from sulfites, bisulfites and sulfinic acid derivatives.

As sulfites and bisulfites that may be used in the composition according to the invention, mention may be made of alkali metal or alkaline-earth metal or ammonium sulfites or bisulfites and in particular sodium or potassium sulfite or bisulfite or alkanolamine sulfites or bisulfites such as monoethanolamine sulfite or bisulfite.

Examples of sulfinic acid derivatives are given in patent FR 2 814 948.

The non-thiol reducing agent(s) generally represent(s) from 0.01% to 50% and preferably from 0.5% to 15% by weight relative to the total weight of the reducing composition.

These thiol or non-thiol reducing agents are generally employed in cosmetically acceptable compositions that are well known per se in the existing prior art of curling formulations for performing the first step (reduction) of a permanent-waving operation. Thus, as common and standard additives that may be used, alone or as mixtures, mention may be made more particularly of surfactants of nonionic, anionic, cationic or amphoteric type, and among these, mention may be made of alkyl sulfates, alkyl benzenesulfates, alkyl ether sulfates, alkyl sulfonates, quaternary ammonium salts, alkylbetaines, fatty acid alkanolamides, oxyethylenated fatty acid esters, and also other nonionic surfactants of the hydroxypropyl ether type.

When the reducing composition contains at least one surfactant, this surfactant is generally present in a maximum concentration of 30% by weight and preferably between 0.5% and 10% by weight relative to the total weight of the reducing composition.

With the aim of improving the cosmetic properties of the hair or of attenuating or preventing its degradation, the reducing composition may also contain a treating agent of cationic, anionic, nonionic or amphoteric nature.

Among the treating agents that are particularly preferred, mention may be made especially of those described in French patent applications 2 598 613 and 2 470 596. The treating agents that may also be used include volatile or non-volatile, linear or cyclic silicones and mixtures thereof, polydimethylsiloxanes, quaternized polyorganosiloxanes such as those described in French patent application 2 535 730, polyorgano-siloxanes containing aminoalkyl groups modified with alkoxycarbonylalkyl groups, such as those described in U.S. Pat. No. 4,749,732, polyorganosiloxanes such as the polydimethylsiloxane-polyoxyalkyl copolymer of the dimethicone copolyol type, a polydimethylsiloxane containing stearoxy-(stearoxydimethicone) end groups, a polydimethylsiloxane-dialkylammonium acetate copolymer or a polydimethylsiloxane-polyalkylbetaine copolymer described in British patent application 2 197 352, polysiloxanes organomodified with mercapto or mercapto-alkyl groups, such as those described in French patent 1 530 369 and in European patent application 295 780, and also silanes such as stearoxytrimethylsilane.

The reducing composition may also contain other treatment ingredients such as cationic polymers, such as those used in the compositions of French patents 79/32078 (FR-A-2 472 382) and 80/26421 (FR-A-2 495 931), or alternatively cationic polymers of the ionene type, such as those used in the compositions of Luxembourg patent 83703, basic amino acids (such as lysine or arginine) or acidic amino acids (such as glutamic acid or aspartic acid), peptides and derivatives thereof, protein hydrolysates, waxes, swelling agents, penetrating agents or agents for improving the efficacy of the reducing agent, such as the $SiO_2$/PDMS (polydimethylsiloxane) mixture, dimethylisosorbitol, urea and its derivatives, pyrroli-done, N-alkylpyrrolidones, thiamorpholinone, alkylene glycol or dialkylene glycol alkyl ethers, for instance propylene glycol monomethyl ether, dipropylene glycol monomethyl ether, ethylene glycol monoethyl ether and diethylene glycol monoethyl ether, $C_3$-$C_6$ alkanediols, for instance 1,2-propanediol and 1,2-butanediol, 2-imidazolidinone, and also other compounds such as pantothenic acid, hair-loss counteractants, antidandruff agents, thickeners, suspension agents, sequestrants, opacifiers, colorants, sunscreens, and also fragrances and preserving agents.

The basifying agent preferably used in the compositions that are useful according to the invention is an agent for increasing the pH of the composition(s) in which it is present. The basifying agent is a Brönsted, Lowry or Lewis base. It may be mineral or organic.

The basifying agent is particularly chosen from:

a) aqueous ammonia, b) alkanolamines such as monoethanolamine, diethanolamine or triethanolamine, and derivatives thereof, c) oxyethylenated and/or oxypropylenated ethylenediamines, d) mineral or organic hydroxides, e) alkali metal silicates such as sodium metasilicates, f) amino acids, preferably basic amino acids, such as arginine, lysine, ornithine, citrulline and histidine, g) (bi)carbonates, particularly primary, secondary or tertiary (ammonium), alkali metal or alkaline-earth metal (bi) carbonates, and h) the compounds of formula (II) below:

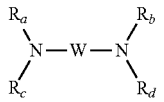

(II)

in which formula (II) W is a propylene residue optionally substituted with a hydroxyl group or a C1-C4 alkyl radical; Ra, Rb, Rc and Rd, which may be identical or different, represent a hydrogen atom or a C1-C4 alkyl or C1-C4 hydroxyalkyl radical.

The mineral or organic hydroxides are preferably chosen from a) hydroxides of an alkali metal, b) hydroxides of an alkaline-earth metal, for instance sodium or potassium hydroxide, c) hydroxides of a transition metal, such as hydroxides of metals from groups III, IV, V and VI, d) lanthanide or actinide hydroxides, quaternary ammonium hydroxides and guanidinium hydroxide.

The hydroxide may be formed in situ, for instance guanidine hydroxide by reacting calcium hydroxide and guanidine carbonate.

Aqueous ammonia and monoethanolamine are preferred.

The basifying agent(s) as defined previously preferably represent(s) from 0.001% to 10% by weight relative to the weight of the composition and more particularly from 0.005% to 8% by weight relative to the weight of the composition. This concentration depends especially on the desired pH of the reducing composition.

According to one preferred embodiment, the reducing composition is left to act for a time of from 1 to 50 minutes and preferably 1 to 30 minutes. Preferably, the reducing composition is applied to clean, wet hair fibres.

The process then optionally includes a step (c) of rinsing the keratin fibres.

Preferably, the process according to the invention includes a rinsing step (c).

Next, the process according to the invention includes a step (d) of placing on a covering means for the said mechanical tensioning means to form a closed space for maintaining a temperature of between 50 and 250° C.

According to the process of the invention, the covering means may be a flexible or rigid material.

The flexible material may be formed by a sheet, a film, a textile or a bonnet. For example, it may be a plastic film, especially made of polyvinylidene chloride or polyvinyl chloride, or aluminium foil.

According to the process of the invention, the system for heating the keratin fibres limits the evaporation of the reducing composition and/or of the rinsing water from the said fibres and keeps the hair at a constant temperature throughout the heating step.

According to the invention, the heating means may be either included in the mechanical tensioning means (heating curlers directly covered with a film, for example), or included in the covering means, or included in both these means. Preferably, the heating means is included in the covering means The heating step (e) then follows.

The heating means may be a heating electrical resistance powered by a battery or a mains connection. This resistance may be incorporated in the tensioning means (for example curlers) or in the covering means (for example a plastic film), or it may be incorporated in both these means.

This heating means is varied and regulated as a function of the desired temperature on the hair.

Preferably, the temperature is between 55° C. and 150° C. and more particularly between 60° C. and 90° C.

The heating time is generally between 1 minute and 2 hours and preferably between 1 and 30 minutes, more preferentially between 5 and 20 minutes and preferably between 10 and 15 minutes.

Advantageously, the closed space produced in step (d) is maintained throughout the heating of step (e), i.e. the covering means is removed only when the heating is complete, i.e., in practice, when the heating is switched off.

Generally, the heating time depends on the set temperature and on the amount of lock wound around the device.

The process according to the invention optionally comprises a step of fixing by oxidation (f), after removal of the covering means, to reform the disulfide bonds, by applying to the keratin fibres an oxidizing composition containing at least one oxidizing agent, optionally followed by a standing time.

The oxidizing composition generally comprises one or more oxidizing agents chosen from hydrogen peroxide, urea peroxide, alkali metal bromates, polythionates, and persalts such as perborates, percarbonates and persulfates.

Preferably, the oxidizing agent is hydrogen peroxide.

The oxidizing agent(s) generally represent(s) from 0.1% to 10% and preferably from 0.5% to 5% by weight relative to the total weight of the oxidizing composition.

Preferably, when the oxidizing agent is aqueous hydrogen peroxide solution, the oxidizing composition used in the process according to the invention contains at least one hydrogen peroxide stabilizer.

Mention may be made in particular of alkali metal or alkaline-earth metal pyrophosphates, such as tetrasodium pyrophosphate, alkali metal or alkaline-earth metal stannates, phenacetin or acid salts of oxyquinoline, for instance oxyquinoline sulfate. Even more advantageously, at least one stannate optionally in combination with at least one pyrophosphate is used.

The hydrogen peroxide stabilizer(s) generally represent(s) from 0.0001% to 5% by weight and preferably from 0.01% to 2% by weight relative to the total weight of the oxidizing composition.

Generally, the pH of the oxidizing composition ranges from 1.5 to 4.5 and preferably from 2 to 3.5.

Preferably, the oxidizing composition as defined above is left to act for about 2 to 30 minutes, preferably for 2 to 15 minutes and more particularly for 2 to 7 minutes.

The process according to the invention may comprise a step of removing the mechanical tensioning devices; a step of rinsing, generally with water, optionally followed by a drying step.

Preferably, the process that is the subject of the invention includes a step of applying a care composition containing a non-silicone cationic polymer or a silicone, preferably an amino silicone.

Among all the non-silicone cationic polymers that may be used in the context of the present invention, it is preferred to employ in the reducing composition cyclopolymers, in particular the dimethyldiallyl-ammonium chloride homopolymers sold under the name Merquat 100 by the company Merck, and quaternary diammonium polymers, and in particular Mexomer PO.

The preferred silicone is the silicone Wacker Belsil ADM LOG 1.

A step of applying a care composition makes it possible to limit or avoid sensitization of the hair that might result from treating the hair with reducing agents and oxidizing agents in the course of the permanent reshaping process that is the subject of the invention. The care composition as defined above also makes it possible to protect the artificial colour of the hair.

The vehicle for the reducing, oxidizing and care compositions is preferably an aqueous medium formed from water and may advantageously contain cosmetically acceptable organic solvents, more particularly including alcohols such as ethyl alcohol, isopropyl alcohol, benzyl alcohol and phenylethyl alcohol, or polyols or polyol ethers, for instance ethylene glycol monomethyl ether, monoethyl ether and monobutyl ether, propylene glycol or ethers thereof, for instance propylene glycol monomethyl ether, butylene glycol, dipropylene glycol, and also diethylene glycol alkyl ethers, for instance diethylene glycol monoethyl ether or monobutyl ether. The organic solvents may then be present in concentrations of between about 0.1% and 20% and preferably between about 1% and 10% by weight relative to the total weight of the composition.

The pH values of the oxidizing composition and of the care composition used in the process according to the invention may be conventionally obtained and/or adjusted by adding either one or more basifying agents, such as those already mentioned in the reducing composition, or acidifying agents, for instance hydrochloric acid, acetic acid, lactic acid, boric acid, citric acid and phosphoric acid.

The reducing composition, the oxidizing composition and the care composition used in the process according to the invention may be, independently of each other, in the form of a thickened or non-thickened lotion, a cream, a gel or a mousse.

As indicated previously, the invention also relates to a mechanical tensioning device comprising:

- at least one means for placing keratin fibres under mechanical tension, and
- at least one means for covering the said fibres, characterized in that the said mechanical tensioning means, the said covering means or these two means have a heating means and are capable of producing a closed space when they are placed on a person's head.

The mechanical tensioning means is a means for shaping keratin fibres. It may be a curler, a roller or a clip.

The covering means may be a flexible or rigid material.

The flexible material may be formed by a sheet, a film, a textile or a hood. For example, it may be aluminium foil or a polyvinylidene chloride or polyvinyl chloride plastic film.

According to one variant of the device according to the invention, the covering means is impermeable, especially to water, such that throughout the heating time, the lock of hair does not dry out. The covering means thus makes it possible to avoid evaporation of the compositions. Thus, the residual water or steam concentration according to the applied temperature, present on the lock of hair, should preferably remain constant throughout the heating time.

According to another variant of the device according to the invention, the covering means is a heat insulator, such that throughout the heating time it acts as an oven, i.e. the heat produced especially by the tensioning means, the covering means or both these means does not dissipate outside the device. The covering means thus allows the temperature to be kept constant throughout the heating step.

According to another variant of the device according to the invention, the covering means may be termed a leaktight adiabatic wall.

According to the invention, the heating means may be either included only in the mechanical tensioning means, or included only in the covering means, or included in both these means. Preferably, the heating means is included in the covering means.

In one particular case, pulsed hot air, steam, heat produced via high-frequency induction, microwaves, infrared radiation, a laser or "flash lamp" irradiation is used as energy source for the process of the invention.

The mechanical tensioning means and the covering means may be independent of each other. They may be adapted by means of their respective mutual shape. They may also be fastened together, for instance connected together via electrical power wires to form a network.

The heating means may be a heating electrical resistance powered by a battery or by a mains connection.

According to one preferred embodiment, the distance between the rolled-up hair around the mechanical tensioning means according to the invention and the covering means is between 0 centimeter, i.e. the covering means may be in contact with the lock or very close to it.

Whether it is flexible or rigid, the covering means may include a raising means, so as to lift the hair above the covering means by a distance of between 0.5 and 5 centimeters.

According to one variant of the device according to the invention, the raising means may be a crown, i.e. armouring that adapts to the circumference of the head, placed thereon, which keeps the covering means at the distance desired by the user.

The heating time and temperature will also depend on the distance between the covering means and the lock of hair wound around the mechanical tensioning means.

Finally, the invention relates to the use of the device as defined above for permanently reshaping keratin fibres.

A subject of the invention is also a kit combining:

- at least one mechanical tensioning device comprising:
  - at least one means for placing keratin fibres under mechanical tension, and
  - at least one means for covering the said fibres, the said mechanical tensioning means, the said covering means or both these means including a heating means and being capable of producing a closed space when they are placed on a person's head, at least one compartment containing a reducing agent, preferably comprising one or more reducing agents chosen from thiol and non-thiol reducing agents.

Optionally, the kit may contain a cosmetic composition including at least one oxidizing agent.

EXAMPLES

The following compositions were prepared (as mass percentages):

A. Reduction in Alkaline Medium

Composition 1 (Reducing Lotion):

| | |
|---|---|
| Thioglycolic acid | 6.8 |
| Ammonium bicarbonate | 2.8 |
| Pentasodium pentetate (as an aqueous 40% solution) | 0.4 |
| Aqueous ammonia (as an aqueous solution containing 20% $NH_3$) | qs pH 8.7 |
| Distilled water | qs 100 |

Composition 2 (Oxidizing Lotion):

| | |
|---|---|
| Sodium bromate | 8 |
| Trisodium phosphate | 0.4 |
| Sodium phosphate | 0.4 |
| Citric acid | qs pH 7.5 |
| Distilled water | qs 100 |

Example 1 (Invention)

Composition 1 was applied for 15 minutes to a 1 g lock of natural Japanese hair wound beforehand on a curler composed of a polyethylene cylinder 1.7 cm in diameter (the curler itself) covering an electrical resistance. After the standing time, the hair was rinsed. The curler was then covered with a plastic polyvinylidene chloride film and connected via an electrical connection to a Digital Perm machine (Oohiro, ODIS-2 model) delivering a power of 10 W per curler. The hair was thus heated at 90° C. for 30 minutes. After this standing time, heating of the curlers was stopped and, after removing the plastic film, composition 2 was applied to the hair for 10 minutes. After this standing time, the hair was unwound, rinsed and then dried in the open air.

The curls thus obtained are very dense.

Example 2 (Reference)

Composition 1 was applied for 15 minutes to a 1 g lock of natural Japanese hair wound beforehand on a curler 1.7 cm in diameter. After the standing time, the hair was rinsed and composition 2 was then applied for 10 minutes. After this further standing time, the hair was unwound, rinsed and dried in the open air. The curls thus obtained are very markedly less tight than in Example 1. The curliness is thus less pronounced.

| | Reduction | Process of the invention | Fixing | Curliness | Curl durability |
|---|---|---|---|---|---|
| Example 1 | Composition 1 15 min. | 90° C. 30 min. | Composition 2 10 min. | ++ | ++ |

-continued

| | Reduction | Process of the invention | Fixing | Curliness | Curl durability |
|---|---|---|---|---|---|
| Example 2 | Composition 1 15 min. | — | Composition 2 10 min. | + | − |

++: Very high curl yield
+: Good curl yield
−: Mediocre curl yield
−−: Very poor curl yield B. Reduction in Acidic Medium (the Reference is Prepared in Basic Medium)

The following compositions were prepared (as mass percentages):

Composition 1 (Reference: Reducing Lotion)

| | |
|---|---|
| Thioglycolic acid | 6.8 |
| Ammonium bicarbonate | 2.8 |
| Pentasodium pentetate (as an aqueous 40% solution) | 0.4 |
| Aqueous ammonia (as an aqueous 20% solution) | qs pH 8.7 |
| Distilled water | qs 100 |

Composition 2 (Reducing Lotion)

| | |
|---|---|
| Thioglycolic acid | 1.0 |
| Pentasodium pentetate (as an aqueous 40% solution) | 0.4 |
| Aqueous ammonia (as an aqueous 20% solution) | qs pH 5.0 |
| Distilled water | qs 100 |

Composition 3 (Reducing Lotion)

| | |
|---|---|
| Thioglycolic acid | 3.0 |
| Pentasodium pentetate (as an aqueous 40% solution) | 0.4 |
| Aqueous ammonia (as an aqueous 20% solution) | qs pH 5.0 |
| Distilled water | qs 100 |

Composition 4 (Oxidizing Lotion)

| | |
|---|---|
| Sodium bromate | 8 |
| Trisodium phosphate | 0.4 |
| Sodium phosphate | 0.4 |
| Citric acid | qs pH 7.5 |
| Distilled water | qs 100 |

Example 1 (Reference)

Composition 1 was applied for 15 minutes to a 1 g lock of natural Japanese hair, wound beforehand on a curler 1.7 cm in diameter. After the standing time, the hair was rinsed and composition 4 was applied for 10 minutes. The hair was then unwound, rinsed and dried in the open air.

Example 2 (Invention)

Composition 2 was applied to a 1 g lock of natural Japanese hair wound beforehand on a curler composed of a polyethylene cylinder 1.7 cm in diameter (the curler itself) covering an electrical resistance. The curler was then covered with a plastic polyvinylidene chloride film and connected via an electrical connection to a Digital Perm machine (Oohiro, ODIS-2 model) delivering a power of 10 W per curler. The hair was thus heated at 90° C. for 15 minutes. After the standing time, the plastic film was removed and the hair was rinsed. After this standing time, composition 4 was applied to the hair for 10 minutes. After this standing time, the hair was unwound, rinsed and then dried in the open air.

Example 3 (Invention)

Composition 2 was applied to a 1 g lock of natural Japanese hair wound beforehand on a curler composed of a polyethylene cylinder 1.7 cm in diameter (the curler itself) covering an electrical resistance. The curler was then covered with a plastic polyvinylidene chloride film and connected via an electrical connection to a Digital Perm machine (Oohiro, ODIS-2 model) delivering a power of 10 W per curler. The hair was thus heated at 90° C. for 15 minutes. After the standing time, the plastic film was removed and the hair was rinsed and then dried in the open air.

Example 4 (Invention)

Composition 2 was applied for 15 minutes to a 1 g lock of natural Japanese hair wound beforehand on a curler composed of a polyethylene cylinder 1.7 cm in diameter (the curler itself) covering an electrical resistance. After the standing time, the plastic film was removed and the hair was rinsed. The curler was then covered with a plastic polyvinylidene chloride film and connected via an electrical connection to a Digital Perm machine (Oohiro, ODIS-2 model) delivering a power of 10 W per curler. The hair was thus heated at 90° C. for 30 minutes. After the standing time, the plastic film was removed and the hair was rinsed and then dried in the open air.

Example 6 (Invention)

Composition 3 was applied to a 1 g lock of natural Japanese hair wound beforehand on a curler composed of a polyethylene cylinder 1.7 cm in diameter (the curler itself) covering an electrical resistance. The curler was then covered with a plastic polyvinylidene chloride film and connected via an electrical connection to a Digital Perm machine (Oohiro, ODIS-2 model) delivering a power of 10 W per curler. The hair was thus heated at 90° C. for 15 minutes. After the standing time, the hair was rinsed. After this standing time, the plastic film was removed and composition 4 was applied to the hair for 10 minutes. After this standing time, the hair was unwound, rinsed and then dried in the open air.

A test of artificial curl durability was performed on the locks of hair thus treated in Examples 1 to 6. To this end, the locks were kept taut for 5 hours at 40° C. and at a relative humidity of 100%. The curl hold is evaluated by comparing the curliness before and after the test.

| | Reduction | Process of the invention | Fixing | Curliness | Curl durability |
|---|---|---|---|---|---|
| Example 1 | Composition 1 15 min. | — | Composition 4 10 min. | + | − |
| Example 2 | Composition 2 | 90° C. - 15 min. | Composition 4 10 min. | + | + |
| Example 3 | Composition 2 | 90° C. - 15 min. | — | + | + |
| Example 4 | Composition 2 15 min. | 90° C. - 30 min. | Composition 4 10 min. | + | + |
| Example 5 | Composition 2 15 min. | 90° C. - 30 min. | — | + | + |
| Example 6 | Composition 3 | 90° C. - 15 min. | Composition 4 10 min. | ++ | + |

++: Very high curl yield
+: Good curl yield
−: Mediocre curl yield

3. Non-Thiol Reducing Agents

The following composition was prepared (as mass percentages):

Composition 1 (Reducing Lotion)

| | |
|---|---|
| Sodium hydrosulfite | 1.12 |
| HCl | qs pH 8.0 |
| Distilled water | qs 100 |

Example 1 (Reference)

Composition 1 was applied for 15 minutes to a 1 g lock of natural Japanese hair, wound beforehand on a curler 1.7 cm in diameter. After the standing time, the hair was rinsed and dried in the open air.

Example 2 (Invention)

Composition 1 was applied for 15 minutes to a 1 g lock of natural Japanese hair wound beforehand on a curler composed of a polyethylene cylinder 1.7 cm in diameter (the curler itself) covering an electrical resistance. The curler was then covered with a plastic polyvinylidene chloride film and connected via an electrical connection to a Digital Perm machine (Oohiro, ODIS-2 model) delivering a power of 10 W per curler. The hair was thus heated at 90° C. for 15 minutes. After the standing time, the plastic film was removed and the hair was rinsed and dried in the open air.

A test of artificial curl durability was performed on the locks of hair treated according to Examples 1 and 2. To this end, the locks were kept taut for 5 hours at 40° C. and at a relative humidity of 100%. The curl hold is evaluated by comparing the curliness before and after the test.

| | Reduction | Process of the invention | Curliness | Curl durability |
|---|---|---|---|---|
| Example 1 | Composition 1 15 min. | — | −− | −− |
| Example 2 | Composition 1 15 min. | 90° C. | ++ | + |

++: Very high curl yield
+: Good curl yield
−: Mediocre curl yield
−−: Very poor curl yield The following compositions were prepared (as mass percentages):

Composition 2 (Reducing Lotion)

| | |
|---|---|
| Sodium sulfite | 6.3 |
| HCl | qs pH 7.0 |
| Distilled water | qs 100 |

Composition 3 (Oxidizing Lotion)

| | |
|---|---|
| Sodium bromate | 8 |
| Trisodium phosphate | 0.4 |
| Sodium phosphate | 0.4 |
| Citric acid | qs pH 7.5 |
| Distilled water | qs 100 |

Example 3 (Reference)

Composition 2 was applied for 15 minutes to a 1 g lock of natural Japanese hair, wound beforehand on a curler 1.7 cm in diameter. After the standing time, the hair was rinsed and composition 3 was then applied for 10 minutes. After the standing time, the hair was rinsed and dried in the open air.

Example 4 (Invention)

Composition 2 was applied for 15 minutes to a 1 g lock of natural Japanese hair wound beforehand on a curler composed of a polyethylene cylinder 1.7 cm in diameter (the curler itself) covering an electrical resistance. After the standing time, the plastic film was removed and the hair was rinsed. The curler was then covered with a plastic polyvinylidene chloride film and connected via an electrical connection to a Digital Perm machine (Oohiro, ODIS-2 model) delivering a power of 10 W per curler. The hair was thus heated at 90° C. for 30 minutes. After the standing time, the hair was rinsed and composition 3 was applied for 10 minutes. The hair was then unwound, rinsed and then dried in the open air.

Example 5 (Invention)

Composition 2 was applied for 15 minutes to a 1 g lock of natural Japanese hair wound beforehand on a curler composed of a polyethylene cylinder 1.7 cm in diameter (the curler itself) covering an electrical resistance. After the standing time, the hair was rinsed. The curler was then covered with a plastic polyvinylidene chloride film and connected via an electrical connection to a Digital Perm machine (Oohiro, ODIS-2 model) delivering a power of 10 W per curler. The hair was thus heated at 90° C. for 30 minutes. After the standing time, the hair was rinsed and dried in the open air.

The artificial curl durability test was performed according to the method described in Examples 1 and 2.

| | Reduction | Process of the invention | Fixing | Curliness | Curl durability |
|---|---|---|---|---|---|
| Example 3 | Composition 2 15 min. | — | Composition 3 10 min. | −− | −− |
| Example 4 | Composition 2 15 min. | 90° C. intra | Composition 3 10 min. | ++ | + |
| Example 5 | Composition 2 15 min. | 90° C. intra | — | ++ | + |

++: Very high curl yield
+: Good curl yield
−: Mediocre curl yield
−−: Very poor curl yield The following compositions were prepared (as mass percentages):

| | Composition 4 | Composition 5 | Composition 6 |
|---|---|---|---|
| Sodium hydrosulfide | 2.8 | — | — |
| Sodium hydrosulfide | — | 8.7 | — |
| Formamidinesulfinic acid | — | — | 6.9 |
| Monoethanolamine | pH 9 | pH 9 | pH 9 |
| Distilled water | qs 100 | qs 100 | qs 100 |

Example 6 (Reference)

Composition 4 was applied for 15 minutes to a 1 g lock of natural Japanese hair, wound beforehand on a curler 1.7 cm in diameter. After the standing time, the hair was rinsed and composition 3 was then applied for 10 minutes. After the standing time, the hair was rinsed and dried in the open air.

Example 7 (Invention)

Composition 4 was applied for 15 minutes to a 1 g lock of natural Japanese hair wound beforehand on a curler composed of a polyethylene cylinder 1.7 cm in diameter (the curler itself) covering an electrical resistance. After the standing time, the hair was rinsed. The curler was then covered with a plastic polyvinylidene chloride film and connected via an electrical connection to a Digital Perm machine (Oohiro, ODIS-2 model) delivering a power of 10 W per curler. The hair was thus heated at 90° C. for 30 minutes. After the standing time, the plastic film was removed and the hair was rinsed and composition 3 was applied for 10 minutes. The hair was then unwound, rinsed and then dried in the open air.

Example 8 (Invention)

Composition 4 was applied for 15 minutes to a 1 g lock of natural Japanese hair wound beforehand on a curler composed of a polyethylene cylinder 1.7 cm in diameter (the curler itself) covering an electrical resistance. After the standing time, the hair was rinsed. The curler was then covered with a plastic polyvinylidene chloride film and connected via an electrical connection to a Digital Perm machine (Oohiro, ODIS-2 model) delivering a power of 10 W per curler. The hair was thus heated at 90° C. for 30 minutes. After the standing time, the hair was rinsed and dried in the open air.

Example 9 (Reference)

Composition 5 was applied for 15 minutes to a 1 g lock of natural Japanese hair, wound beforehand on a curler 1.7 cm in diameter. After the standing time, the hair was rinsed and composition 3 was then applied for 10 minutes. After the standing time, the hair was rinsed and dried in the open air.

Example 10 (Invention)

Composition 5 was applied for 15 minutes to a 1 g lock of natural Japanese hair wound beforehand on a curler composed of a polyethylene cylinder 1.7 cm in diameter (the curler itself) covering an electrical resistance. After the standing time, the hair was rinsed. The curler was then covered with a plastic polyvinylidene chloride film and connected via an electrical connection to a Digital Perm machine (Oohiro, ODIS-2 model) delivering a power of 10 W per curler. The hair was thus heated at 90° C. for 30 minutes. After the standing time, the plastic film was removed and the hair was rinsed and composition 3 was applied for 10 minutes. The hair was then unwound, rinsed and then dried in the open air.

Example 11 (Invention)

Composition 5 was applied for 15 minutes to a 1 g lock of natural Japanese hair wound beforehand on a curler composed of a polyethylene cylinder 1.7 cm in diameter (the curler itself) covering an electrical resistance. After the standing time, the hair was rinsed. The curler was then covered with a plastic polyvinylidene chloride film and connected via an electrical connection to a Digital Perm machine (Oohiro, ODIS-2 model) delivering a power of 10 W per curler. The hair was thus heated at 90° C. for 30 minutes. After the standing time, the hair was rinsed and dried in the open air.

Example 12 (Reference)

Composition 6 was applied for 15 minutes to a 1 g lock of natural Japanese hair, wound beforehand on a curler 1.7 cm in diameter. After the standing time, the hair was rinsed and composition 3 was then applied for 10 minutes. After the standing time, the hair was rinsed and dried in the open air.

Example 13 (Invention)

Composition 6 was applied for 15 minutes to a 1 g lock of natural Japanese hair wound beforehand on a curler composed of a polyethylene cylinder 1.7 cm in diameter (the curler itself) covering an electrical resistance. After the standing time, the hair was rinsed. The curler was then covered with a plastic polyvinylidene chloride film and connected via an electrical connection to a Digital Perm machine (Oohiro, ODIS-2 model) delivering a power of 10 W per curler. The hair was thus heated at 90° C. for 30 minutes. After the standing time, the hair was rinsed and composition 3 was applied for 10 minutes. The hair was then unwound, rinsed and then dried in the open air.

Example 14 (Invention)

Composition 6 was applied for 15 minutes to a 1 g lock of natural Japanese hair wound beforehand on a curler composed of a polyethylene cylinder 1.7 cm in diameter (the curler itself) covering an electrical resistance. After the standing time, the plastic film was removed and the hair was rinsed. The curler was then covered with a plastic polyvinylidene chloride film and connected via an electrical connection to a Digital Perm machine (Oohiro, ODIS-2 model) delivering a power of 10 W per curler. The hair was thus heated at 90° C. for 30 minutes. After the standing time, the plastic film was removed and the hair was rinsed and dried in the open air.

The artificial curl durability test was performed according to the method described in Examples 1 and 2.

| | Reduction | Process of the invention | Fixing | Curliness | Curl durability |
|---|---|---|---|---|---|
| Example 6 | Composition 4 15 min. | — | Composition 3 10 min. | − | −− |
| Example 7 | Composition 4 15 min. | 90° C. intra | Composition 3 10 min. | ++ | ++ |
| Example 8 | Composition 4 15 min. | 90° C. intra | — | ++ | ++ |
| Example 9 | Composition 5 15 min. | — | Composition 3 10 min. | −− | −− |
| Example 10 | Composition 5 15 min. | 90° C. intra | Composition 3 10 min. | ++ | + |
| Example 11 | Composition 5 15 min. | 90° C. intra | — | ++ | + |
| Example 12 | Composition 6 15 min. | — | Composition 3 10 min. | −− | −− |
| Example 13 | Composition 6 15 min. | 90° C. intra | Composition 3 10 min. | + | + |
| Example 14 | Composition 6 15 min. | 90° C. intra | — | + | + |

++: Very high curl yield

+: Good curl yield

−: Mediocre curl yield

−−: Very poor curl yield

4. Reducing Agent Cysteine Type and Derivatives

The following compositions were prepared (as mass percentages):

Composition 1 (Reducing Lotion)

| | |
|---|---|
| DL-Cysteine | 6.06 |
| Ammonium bicarbonate | 2.8 |
| Pentasodium pentetate (as an aqueous 40% solution) | 0.4 |
| Monoethanolamine | qs pH 8.7 |
| Distilled water | qs 100 |

Composition 2 (Reducing Lotion)

| | |
|---|---|
| N-Acetylcysteine | 8.15 |
| Ammonium bicarbonate | 2.8 |
| Pentasodium pentetate (as an aqueous 40% solution) | 0.4 |
| Monoethanolamine | qs pH 8.7 |
| Distilled water | qs 100 |

Composition 3 (Oxidizing Lotion)

| | |
|---|---|
| Hydrogen peroxide (as an aqueous 35% solution) | 5.15 |
| Sodium salicylate | 0.04 |
| Tetrasodium pyrophosphate | 0.05 |
| Phosphoric acid | qs pH 3 |
| Distilled water | qs 100 |

Example 1 (Invention)

Composition 1 was applied for 15 minutes to a 1 g lock of natural Japanese hair wound beforehand on a curler composed of a polyethylene cylinder 1.7 cm in diameter (the curler itself) covering an electrical resistance. After the standing time, the plastic film was removed and the hair was rinsed. The curler was then covered with a plastic polyvinylidene chloride film and connected via an electrical connection to a Digital Perm machine (Oohiro, ODIS-2 model) delivering a power of 10 W per curler. The hair was thus heated at 90° C. for 30 minutes. After the standing time, the hair was rinsed. Composition 3 was applied to the hair for minutes. After this standing time, the hair was unwound, rinsed and then dried in the open air.

Example 2 (Reference)

Composition 1 was applied for 15 minutes to a 1 g lock of natural Japanese hair, wound beforehand on a curler 1.7 cm in diameter. After the standing time, the hair was rinsed and composition 3 was applied for 5 minutes. The hair was then unwound, rinsed and dried in the open air.

Example 3 (Invention)

Composition 2 was applied for 15 minutes to a 1 g lock of natural Japanese hair wound beforehand on a curler composed of a polyethylene cylinder 1.7 cm in diameter (the curler itself) covering an electrical resistance. After the standing time, the hair was rinsed. The curler was then covered with a plastic polyvinylidene chloride film and connected via an electrical connection to a Digital Perm machine (Oohiro, ODIS-2 model) delivering a power of 10 W per curler. The hair was thus heated at 90° C. for 30 minutes. After the standing time, the plastic film was removed and the hair was rinsed. Composition 3 was applied to the hair for 5 minutes. After this standing time, the hair was unwound, rinsed and then dried in the open air.

Example 4 (Reference)

Composition 2 was applied for 15 minutes to a 1 g lock of natural Japanese hair, wound beforehand on a curler 1.7 cm in diameter. After the standing time, the hair was rinsed and composition 3 was applied for 5 minutes. The hair was then unwound, rinsed and dried in the open air.

Example 5 (Invention)

Composition 1 was applied for 15 minutes to a 1 g lock of natural Japanese hair wound beforehand on a curler composed of a polyethylene cylinder 1.7 cm in diameter (the curler itself) covering an electrical resistance. After the standing time, the plastic film was removed and the hair was rinsed. The curler was then covered with a plastic polyvinylidene chloride film and connected via an electrical connection to a Digital Perm machine (Oohiro, ODIS-2 model) delivering a power of 10 W per curler. The hair was thus heated at 90° C. for 30 minutes After the standing time, the hair was rinsed and then dried in the open air.

Example 6 (Reference)

Composition 1 was applied for 15 minutes to a 1 g lock of natural Japanese hair, wound beforehand on a curler 1.7 cm in diameter. After the standing time, the hair was rinsed and dried in the open air.

Example 7 (Invention)

Composition 2 was applied for 15 minutes to a 1 g lock of natural Japanese hair wound beforehand on a curler composed of a polyethylene cylinder 1.7 cm in diameter (the curler itself) covering an electrical resistance. After the standing time, the plastic film was removed and the hair was rinsed. The curler was then covered with a plastic polyvinylidene chloride film and connected via an electrical connection to a Digital Perm machine (Oohiro, ODIS-2 model) delivering a power of 10 W per curler. The hair was thus heated at 90° C. for 30 minutes. After the standing time, the hair was rinsed and then dried in the open air.

Example 8 (Reference)

Composition 2 was applied for 15 minutes to a 1 g lock of natural Japanese hair, wound beforehand on a curler 1.7 cm in diameter. After the standing time, the hair was rinsed and dried in the open air.

A test of artificial curl durability was performed on the locks of hair thus treated in Examples 1 to 6. To this end, the locks were kept taut for 5 hours at 40° C. and at a relative humidity of 100%. The curl hold is evaluated by comparing the curliness before and after the test.

| | Reduction | Process of the invention | Fixing | Curliness | Curl durability |
|---|---|---|---|---|---|
| Example 1 | Composition 1 15 min. | 90° C. 30 min. | Composition 3 5 min. | ++ | ++ |
| Example 2 | Composition 1 15 min. | — | Composition 3 5 min. | − | − |
| Example 3 | Composition 2 15 min. | 90° C. 30 min. | Composition 3 5 min. | + | + |
| Example 4 | Composition 2 15 min. | — | Composition 3 5 min. | − | − |
| Example 5 | Composition 1 15 min. | 90° C. 30 min. | — | ++ | ++ |
| Example 6 | Composition 1 15 min. | — | — | − | −− |
| Example 7 | Composition 2 15 min. | 90° C. 30 min. | — | + | + |
| Example 8 | Composition 2 15 min. | — | — | −− | −− |

++: Very high curl yield
+: Good curl yield
−: Mediocre curl yield
−−: Very poor curl yields

The invention claimed is:

1. A process for permanently reshaping keratin fibres comprising:

a) placing the keratin fibres under mechanical tension by rolling keratin fibres on a tensioning device so as to form curls, b) applying a reducing composition to the keratin fibres, c) individually covering each tensioning device rolled with keratin fibres with a cover comprising at least one heat-insulating material chosen from aluminum foil, polyvinylidine chloride, and polyvinyl chloride, so as to form at least one closed space above the keratin fibres, d) heating the keratin fibres at a constant temperature ranging from 45 to 250° C., with a variation of about 3° C., for a period of time ranging from 1 minute to 2 hours, and e) entrapping heat and condensation from the heating of the keratin fibres within the closed space so as to maintain the closed space at a substantially uniform temperature throughout the closed space, wherein at least one of the tensioning device and the cover comprising at least one heat-insulating material further includes at least one heat source as part of the at least one tensioning device and the cover.

2. The process of claim 1, further comprising rinsing said fibres before covering.

3. The process of claim 1, further comprising the steps of:

f) removing the cover after heating, and g) applying at least one oxidizing composition to the fibres.

4. The process of claim 1, further comprising the steps of:

b1) rinsing said fibres before covering, f) removing the cover after heating, and g) applying at least one oxidizing composition to the fibres.

5. The process according to claim 1 wherein the cover comprises open regions further comprising a surface area less than 5% of the total area of the cover.

6. The process according to claim 5 wherein the cover comprises open regions further comprising a surface area less than 3% of the total area of the cover.

7. The process according to claim 6 wherein the cover comprises open regions further comprising a surface area less than 0.5% of the total area of the cover.

8. The process according to claim 1 wherein the cover consists of heat insulating material.

9. The process according to claim 1 wherein the heat source is adjusted so that the constant temperature is greater than or equal to 70° C.

10. The process according to claim 1 wherein the heat source is adjusted so that the constant temperature ranges from 75 to 150° C.

11. The process according to claim 1 wherein the heat source is adjusted so that the constant temperature is less than 100° C.

12. The process according to claim 1 wherein the at least one heat source comprises electrical resistance.

13. The process according to claim 1 wherein the cover comprising at least one heat-insulating material is impermeable to the reducing composition.

14. The process according to claim 1 wherein the cover is placed less than 20 mm from the keratin fibres.

15. The process according to claim 14 wherein the cover is placed less than 10 mm from the keratin fibres.

16. The process according to claim 15 wherein the cover is placed less than 5 mm from the keratin fibres.

17. The process according to claim 1 wherein the keratin fibres are hair.

* * * * *